US006021714A

United States Patent [19]

Grove et al.

[11] Patent Number: 6,021,714

[45] Date of Patent: Feb. 8, 2000

[54] SHAPED CHARGES HAVING REDUCED SLUG CREATION

[75] Inventors: Brenden M. Grove, Missouri City; Jack F. Lands, Jr., West Columbia; Robert A. Parrott, Houston, all of Tex.

[73] Assignee: Schlumberger Technology Corporation, Sugar Land, Tex.

[21] Appl. No.: 09/017,605

[22] Filed: Feb. 2, 1998

[51] Int. Cl.[7] ..... F42B 1/02

[52] U.S. Cl. ..... 102/307; 102/309; 102/476

[58] Field of Search ..... 102/307, 309, 102/310, 476

[56] References Cited

U.S. PATENT DOCUMENTS

| | | | |
|---|---|---|---|
| 4,041,866 | 8/1977 | Thevenin et al. | 102/24 HC |
| 4,341,983 | 7/1982 | Gottliebson | 318/102 |
| 4,491,500 | 1/1985 | Michaud et al. | 156/628 |
| 4,498,367 | 2/1985 | Skolnick et al. | 102/307 X |
| 4,499,830 | 2/1985 | Majerus et al. | 102/476 |
| 4,702,171 | 10/1987 | Tal et al. | 102/307 X |
| 4,766,813 | 8/1988 | Winter et al. | 102/307 X |
| 4,818,333 | 4/1989 | Michaud | 102/476 |
| 4,958,569 | 9/1990 | Mandigo | 102/476 |
| 5,090,324 | 2/1992 | Rocker et al. | 102/307 |
| 5,259,317 | 11/1993 | Lips et al. | 102/307 |
| 5,619,008 | 4/1997 | Chawla et al. | 102/307 X |

FOREIGN PATENT DOCUMENTS

| | | |
|---|---|---|
| 0 105 495 A1 | 4/1984 | European Pat. Off. . |
| 832685 | 4/1960 | United Kingdom . |
| 854043 | 11/1960 | United Kingdom . |
| 1 504 431 | 2/1978 | United Kingdom . |
| 2 303 687 | 2/1997 | United Kingdom . |
| 2 326 220 | 12/1998 | United Kingdom . |

OTHER PUBLICATIONS

Walters et al., "Fundamentals of Shaped Charges," pp. 339–351 (John Wiley & Sons, 1989).

Delacour et al., "A New Approach to Elimination of Slug in Shaped Charge Perforating," Paper No. 941–G, pp. 1–10 (1957).

*Primary Examiner*—Peter A. Nelson

*Attorney, Agent, or Firm*—Jeffrey E. Griffin; Jaime A. Castano; John J. Ryberg

[57] ABSTRACT

A shaped charge for use in perforating formation adjacent a wellbore includes a liner having a substantially non-conical shape (also referred to as bowl-shaped). The liner has first and second layers, with a first layer contacting the main explosive charge. The second layer (made of such materials as copper, silver, gold, and so forth) contributes primarily to formation of a perforating jet while the first layer contains a material that substantially disintegrates upon detonation such that formation of a slug is reduced or eliminated.

14 Claims, 5 Drawing Sheets

SHAPED CHARGES HAVING REDUCED SLUG CREATION

BACKGROUND

The invention is generally related to shaped charges having reduced slug creation.

After a well has been drilled and casing has been cemented in the well, perforations are created to allow communication of fluids between pay zones in the formation and the wellbore. Shaped charge perforating is commonly used, in which shaped charges are mounted in perforating guns that are conveyed into the well on either an electric line (e.g., a wireline) or tubing (e.g. production tubing, drill pipe, or coiled tubing).

Shaped charges are considered "high explosives"; that is, they detonate at very rapid rates and generate tremendous pressures. There are two types of shaped charges: generally conical shaped charges designed of deep penetration into a formation; and substantially non-conical shaped charges designed for creation of big holes through the casing and shallow penetration into the surrounding formation.

Referring to FIG. 1A, a generally conical shaped charge 10 includes an outer case 12 that acts as a containment vessel designed to hold the detonation force of the detonating explosive long enough for a perforating jet to form. Common materials used for the outer case 12 include steel, zinc, aluminum, ceramics, and glass.

A main explosive charge 16 is contained inside the outer case 12 and is sandwiched between the inner wall of the outer case 12 and the outer surface of a liner 20 that has generally a conical shape. A primer 14 provides the detonating link between a detonating cord (not shown) and the main explosive charge 16. The primer 14 is initiated by the detonating cord, which in turn initiates detonation of the main explosive charge 16 to create a detonation wave that sweeps through the shaped charge 10.

Referring to FIG. 1B, upon detonation, the liner 20 (original liner 20 represented with dashed lines) collapses under the detonation force of the main explosive charge 16. Material from the collapsed liner 20 flows along streams (such as those indicated as 29) to form a perforating jet 26 along the X axis. If the liner 20 is constructed of a solid metal, a slug 28 (sometimes referred to as a "carrot") is also formed as a byproduct of the explosive detonation and liner-to-jet formation process. With deep perforations having relatively small hole diameters, these slugs can plug up the perforated tunnels and potentially reduce fluid flow.

Different portions of the liner 20 contribute to creation of the slug 28 and the perforating jet 26. The inner conical portion 30 of the liner 20 forms the jet 26 while the outer conical portion 32 of the conical liner 20 forms the slug 28. For conical liners, the partition between the jet-producing and slug-producing portions of the liner lies along a cone (represented as 31) between the inner and outer portions 30 and 32. A point P represents a point of stagnation that divides the slug 28 and the perforating jet 26 for conical liners. The exact location of the separation surface 31 depends on the apex angle of the conical liner and other factors, but all liners of a generally conical shape exhibit this type of separation between slug-producing and jet-producing liner regions.

To reduce or eliminate formation of these slugs, conical liners formed of powdered metal have been used. The powdered metal does leave behind a mass of non-jet material, but the non-solid material is distributed along the perforated hole and does not form a solid slug.

Conical shaped charges have also used bi-metallic liners to reduce or eliminate formation of the slugs. A bi-metallic liner includes two layers of metal, both conically shaped, that are pressed to fit together to form a first cone (which contacts the main explosive charge) and a second cone (which faces the air side). One layer contributes to formation of the perforating jet, while the other layer, if selected of an appropriate metal such as zinc, disintegrates so that formation of a solid slug is reduced.

The other type of shaped charge, the substantially non-conical shaped (e.g., pseudo-hemispherical, parabolic or other similar shape) charge, is designed to create large entrance holes in casing and reduced penetration into the cement or formation. These types of shaped charges are also referred to as big hole charges. Solid metal liners as well as powdered metal liners have been used with the big hole shaped charges. Use of solid metal liners in these charges can also produce slugs. To reduce or eliminate the slug in the big hole shaped charges, powdered metal liners have been used. However, use of powdered metal liners have typically reduced performance of these charges as well as increase manufacturing complexity.

Another proposed shaped charge uses a wrought copper alloy liner, which includes an alloy that is multiple phase; that is, the alloy includes a ductile matrix and a discrete second phase, the second phase having a melting temperature less than the temperature reached by the liner after detonation.

SUMMARY

Generally, the invention is directed to a shaped charge including a liner that has a portion that is substantially non-conical, with the liner having multiple layers having preselected materials to reduce creation of a slug.

In general, in one aspect, the invention features a shaped charge that includes a case, an explosive charge contained in the case, and a liner having a substantial portion that is generally bowl-shaped. The liner includes a first layer of a first material contacting the explosive charge and a second layer of a second, different material. The first material has a low temperature melting point.

In general, in another aspect, the invention features a method of making a shaped charge. An explosive charge is positioned in a case. A liner is shaped to be generally bowl-shaped. The liner has a first layer and a second layer, with the first layer and second layer being made of different materials. The liner is contacted to the explosive charge.

Other features and advantages will become apparent from the following description and from the claims.

DETAILED DESCRIPTION

Figure 2:
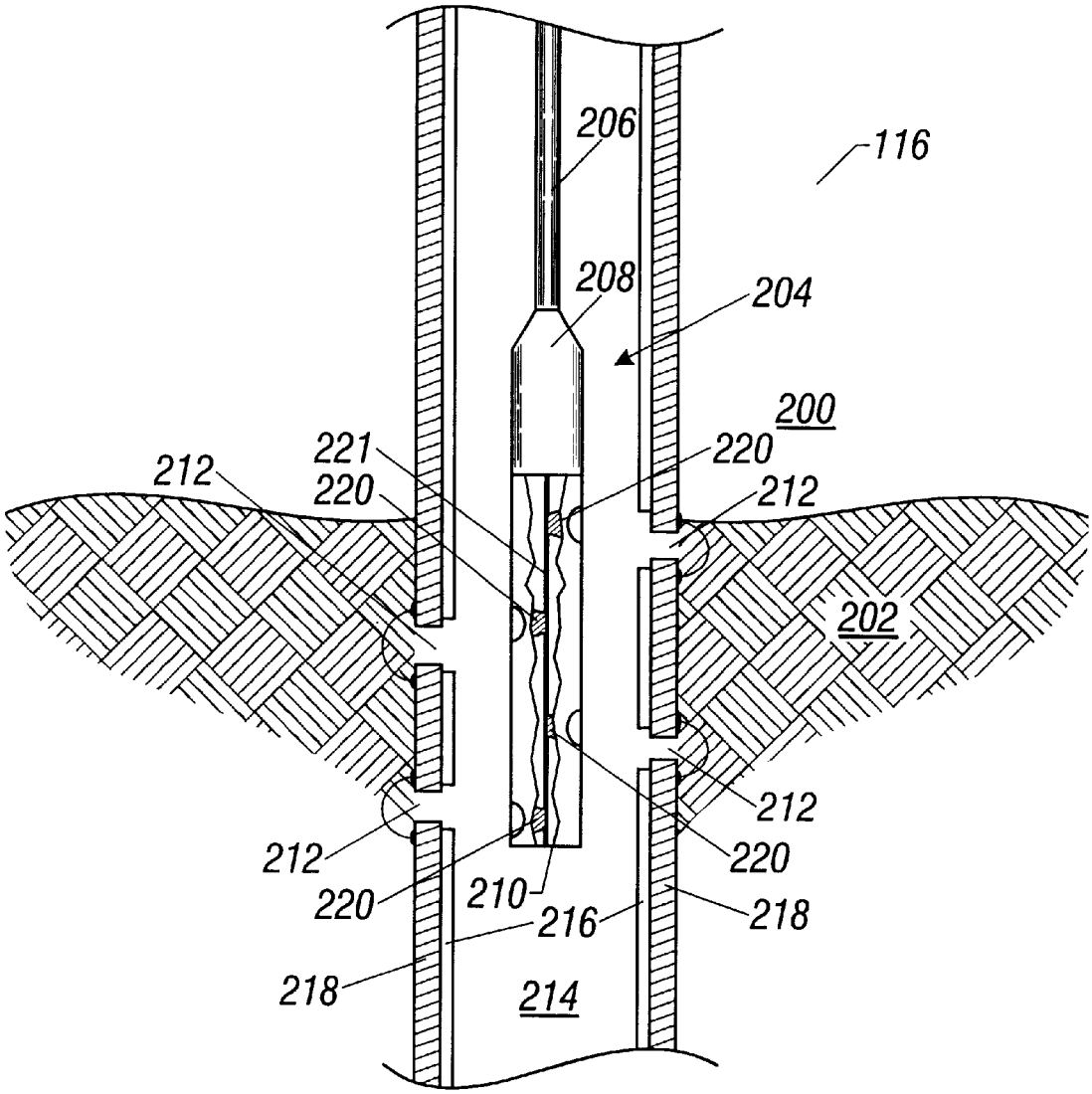
FIG. 2 is a diagram of a perforating gun positioned in a well.

Referring to FIG. 2, an exemplary perforating string 204 is positioned in a wellbore 214 adjacent a pay zone 202 in a formation 200. The wellbore 214 is cased by casing 216 that is held in place by a cement layer 218. The perforating string 204 is carried by a tubing 206 (which can be, for example, a coiled tubing). Alternatively, the perforating string 204 can be carried by a wireline. The tubing 206 is connected to a firing head 208, which is in turn connected to a perforating gun 210. The perforating gun 210 contains shaped charges 220 (which are detonated by a detonating cord 221 connected to the firing head 208 and the shaped charges 220) that are designed to create perforations in the adjacent casing 216, cement layer 218, and pay zone 202 having relatively large hole diameters. The perforating gun 210 can be of any type, such as: (1) a pressure bearing hollow carrier system (generally shown in FIG. 2) within which the shaped charges are substantially isolated from the wellbore fluid; (2) a strip or other carrier system (not shown) upon which the shaped charges are attached, wherein the shaped charges are exposed to the wellbore fluid; or (3) any other retrievable or expendable carrier means for containing shaped charges that are conveyed into a wellbore. The types of shaped charges that can create such perforations include shaped charges having liners of a substantially non-conical shape (e.g., pseudo-hemispherical, parabolic, tulip-shaped, and other similar shapes). Such shaped charges are also commonly referred to as big hole shaped charges. In this application, liners that are substantially non-conically shaped are also referred to as being generally bowl-shaped.

Various phased schemes can be used to create perforations in the casing and formation. For example, popular phasings for the shaped charges 220 include 180° phasing (illustrated in FIG. 2), 60° phasing, and 45° phasing.

Perforations having a hole of a relatively large diameter are particularly advantageous for use in controlling sand flow into the wellbore 214 from the surrounding pay zone 202. After perforations 212 are created through the casing 216 and the cement 218 into the adjacent pay zone 202, the perforating string 204 is removed and equipment to perform gravel packing can be lowered into the wellbore 214 to pack gravel into and around the big hole perforations 212. The gravel acts as a filter to prevent sand from flowing while still allowing flow of well fluids. Big hole perforations can also be used in other applications.

For improved performance, the shaped charges 220 used in the perforating gun 210 to create the desired big hole perforations contain liners that are generally bowl-shaped and have multiple layers made of preselected materials. In one embodiment, a bi-metallic liner is used, in which one layer is designed to generate the perforating jet and the second layer is made of a low temperature melting point material that disintegrates upon detonation to reduce or eliminate formation of a slug.

Figure 3A:
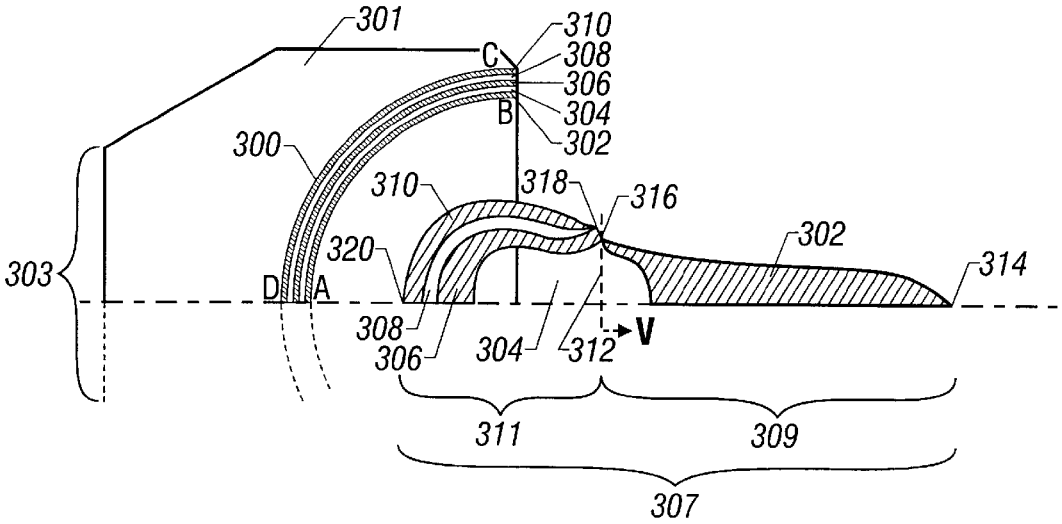
FIGS. 3A and 3B are diagrams illustrating the collapse of a substantially non-conical liner.
Figure 3B:
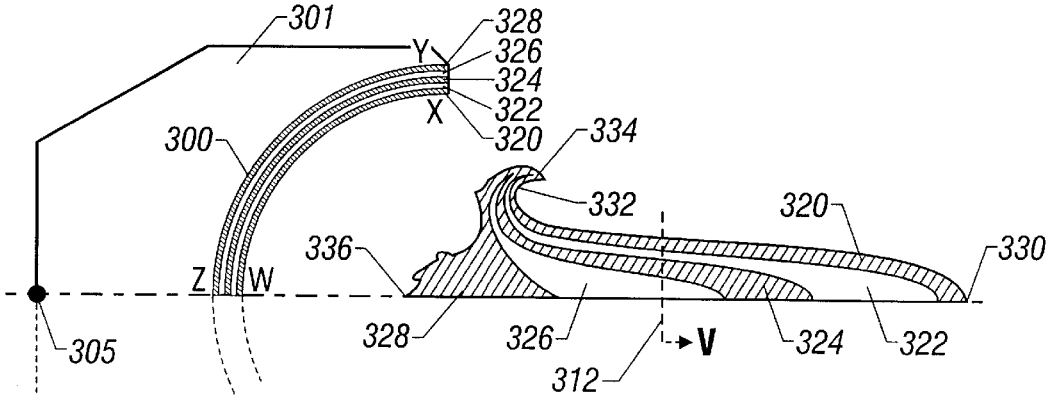

Reference is made to FIGS. 3A and 3B to explain how a shaped charge having a solid metal liner that is generally bowl-shaped functions to create a perforating jet and a slug. FIGS. 3A and 3B illustrate the perforating characteristic of a parabolic liner 300 (which is one example of a generally bowl-shaped liner) attached to a main explosive charge 301. The liner 300 used in each of the examples of FIGS. 3A and 3B is a solid metal liner (e.g., such as a copper liner). For illustrative purposes only, the solid metal liner 300 is divided into five different sections (labeled sections 302, 304, 306, 308, and 310). The parabolic liner 300 is identical in both examples, except the method of initiation differs. The example of FIG. 3A uses a surface-initiated charge (in which initiation of the main explosive charge 301 is performed at the entire surface 303), while the example of FIG. 3B uses a point-initiated charge (in which initiation of the main explosive charge 301 is performed at a point 305). Other methods of initiation are also possible, such as ring-initiated charges. As illustrated by the two examples, the way in which the substantially non-conical liner 300 collapses is highly dependent upon the way in which initiation is performed.

In FIG. 3A, a stream 307 is created when the liner 300 collapses. The high velocity section 309 (which forms part of the perforating jet) includes primarily the section 302 of the liner 300. A line 312 indicates where the material is traveling at faster than a predetermined velocity V. The slower moving portion 311 of the jet includes sections 304, 306, 308, and 310. A part of this slow moving portion 311 of this liner ultimately forms the solid slug when the solid metal liner 300 is used.

The following describes which portions of the liner 300 contributes to which portions of the collapsed liner stream 307. The tip portion 314 of the stream 307 originates from portion A of the liner 300; the portion 316 of the jet corresponds to portion B of the liner 300; the portion 318 of the jet corresponds to portion C of the liner 300; and the portion 320 of the jet corresponds to portion D of the liner 300.

In FIG. 3B, the point-initiated explosive charge causes the liner 300 to collapse in a significantly different way. As illustrated, the fast moving portion of the liner stream includes sections 320, 322 and 324 of the liner 300. The shape of the perforating jet is also quite different. The tip portion 330 of the jet is contributed by portion W in the liner 300; the portion 332 of the jet is contributed by portion X of the liner; portion 334 of the jet corresponds to portion Y of the liner 300; and portion 336 of the jet is contributed by portion Z of the liner 300.

Figure 1A:
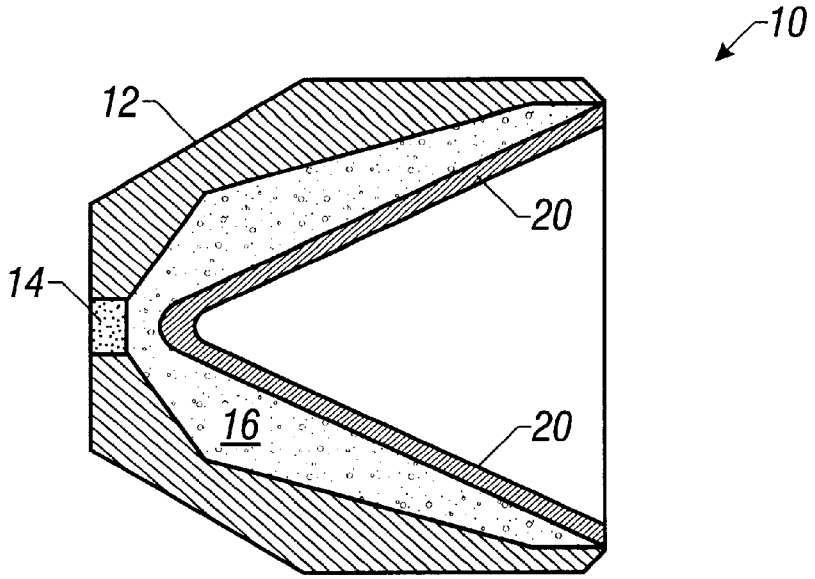
FIG. 1A is a cross-sectional view of a shaped charge having a generally conical liner.
Figure 1B:
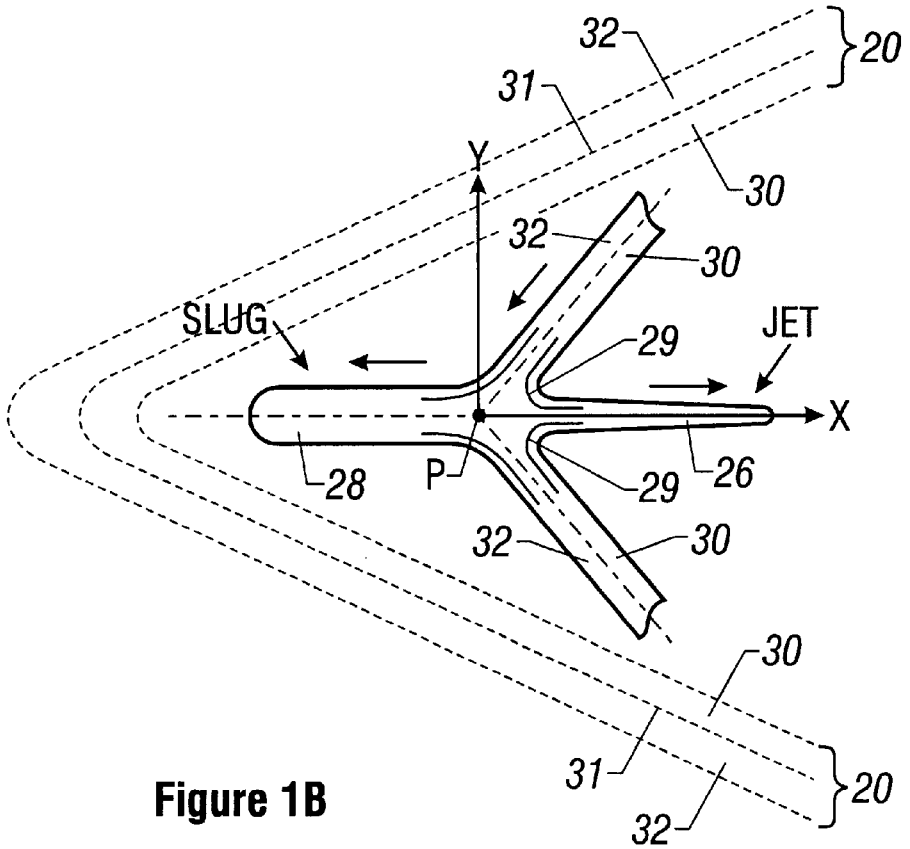
FIG. 1B is a diagram illustrating the collapse of the conical liner of FIG. 1A.

Thus, as illustrated by the examples of FIGS. 3A and 3B, the collapse characteristics of generally bowl-shaped liners are quite different than the collapse characteristics of conical liners. As illustrated by FIG. 1B, for conical liners, the separation line between the slug and jet producing portions is similar for different configurations of conical liners under different initiation conditions. However, for a liner that is substantially non-conical, such uniformity of behavior does not exist. Different methods of initiation can cause an identical liner to collapse in significantly different ways. Further, different types of non-conical liners (e.g., generally parabolic, generally hemispherical, generally tulip-shaped, and so forth) have different collapse mechanisms. Consequently, for substantially non-conical liners, the behavior of a multi-layered liner that is designed to reduce slug production is much more difficult to predict.

Figure 4A:
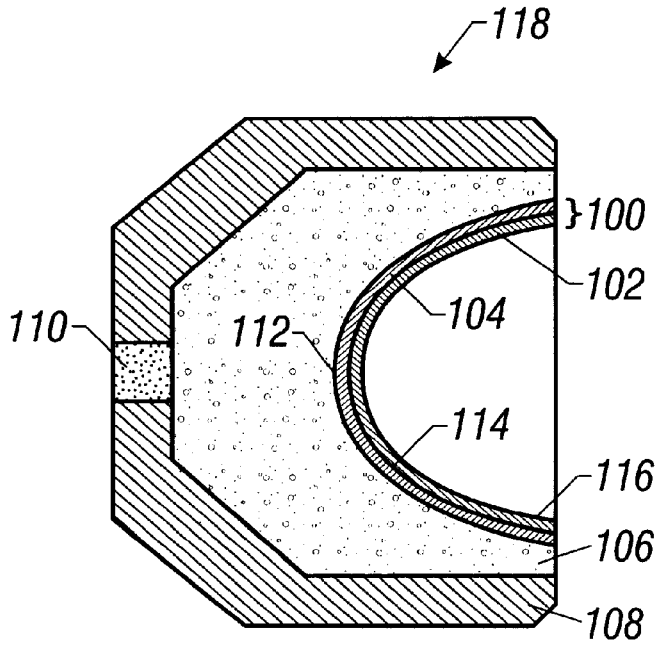
FIGS. 4A and 4B are cross-sectional views of shaped charges according to the present invention.
Figure 4B:
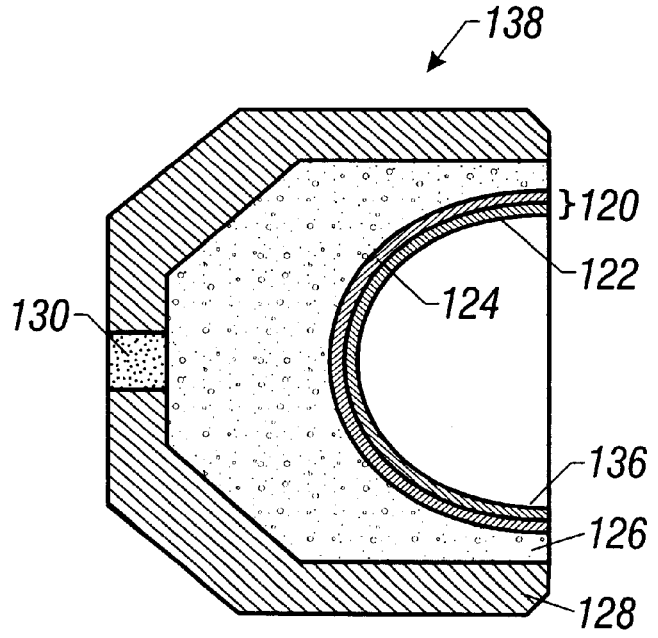

Referring to FIGS. 4A and 4B, shaped charges having substantially non-conical liners that are multi-layered are shown. In FIG. 4A, a shaped charge 118 includes a liner 100 having generally a parabolic shape with an inner or second layer 102 and an outer or first layer 104. The thicknesses of the layers 102 and 104 are selected at a predetermined ratio. A ratio of the thickness of the layer 102 to the layer 104 can be selected from the exemplary range of 2:1 to 1:2. Testing of a shaped charge having generally a parabolic bi-metallic liner with an outer layer 104 including zinc and an inner layer 102 including copper showed successful results (i.e., reduced slug production) where the zinc layer had a thickness of 12 mils and the copper layer 102 had one of the following thicknesses: 12 mils (1:1 copper-to-zinc ratio), 16 mils (4:3 ratio), and 21 mils (7:4 ratio). However, other possible ratios also include an inner layer 102 thickness to outer layer 104 thickness ratio selected from the range of 3:1 to 1:3. Larger ranges of ratios are also possible.

The inner layer 102 in the generally bowl-shaped liner 100 primarily contributes to formation of the perforating jet, while the outer layer 104 is made of a material having a low-melting point that disintegrates upon detonation such that a solid slug is not formed. Exemplary materials for the inner layer 102 includes copper, nickel, silver, gold, tantalum, metal alloys, or some other high density and ductile material. The inner layer 102 can also be made of particulated (or powdered) material or a brittle material. The outer layer 104 can include such metals as zinc, lead, a tin-lead alloy (such as a eutectic tin-lead alloy), powdered metal, plastic, nylon, a plastic filled with particulated metal, epoxy and other materials. The convex surface 112 of the outer layer 104 presses against the main explosive charge 106 of the shaped charge 118. The explosive charge 106 is contained in an outer case 108. A primer 110 is coupled to initiate the main explosive charge 106.

FIG. 4B shows another embodiment of a substantially non-conical shaped charge, in this case a pseudo-hemispherical shaped charge 138. In general, the layered design for the pseudo-hemispherical liner 120 is similar to the design of the parabolic liner 100. The ratio of the thicknesses of the two layers 122 and 124 in the liner 120 can be varied to adjust for the different behavior of the different shaped liners.

Other embodiments of substantially non-conical shaped charges can also be used, such as tulip-shaped charges.

Using the liners described, a shaped charge having improved characteristics can be created. Creation of a slug can be reduced or eliminated while at the same time maintaining good big hole perforation performance.

In addition, if desired, the ratio of the thicknesses of the layers in a multi-layered generally bowl-shaped liner can be selected to reduce penetration depth of the perforations. One way of doing this is to increase the thickness of the outer layer (the layer contacting the explosive charge) with respect to the thickness of the inner layer. By reducing the amount of material in the inner layer, the perforating jet force can be decreased to reduce penetration depth.

Figure 5:
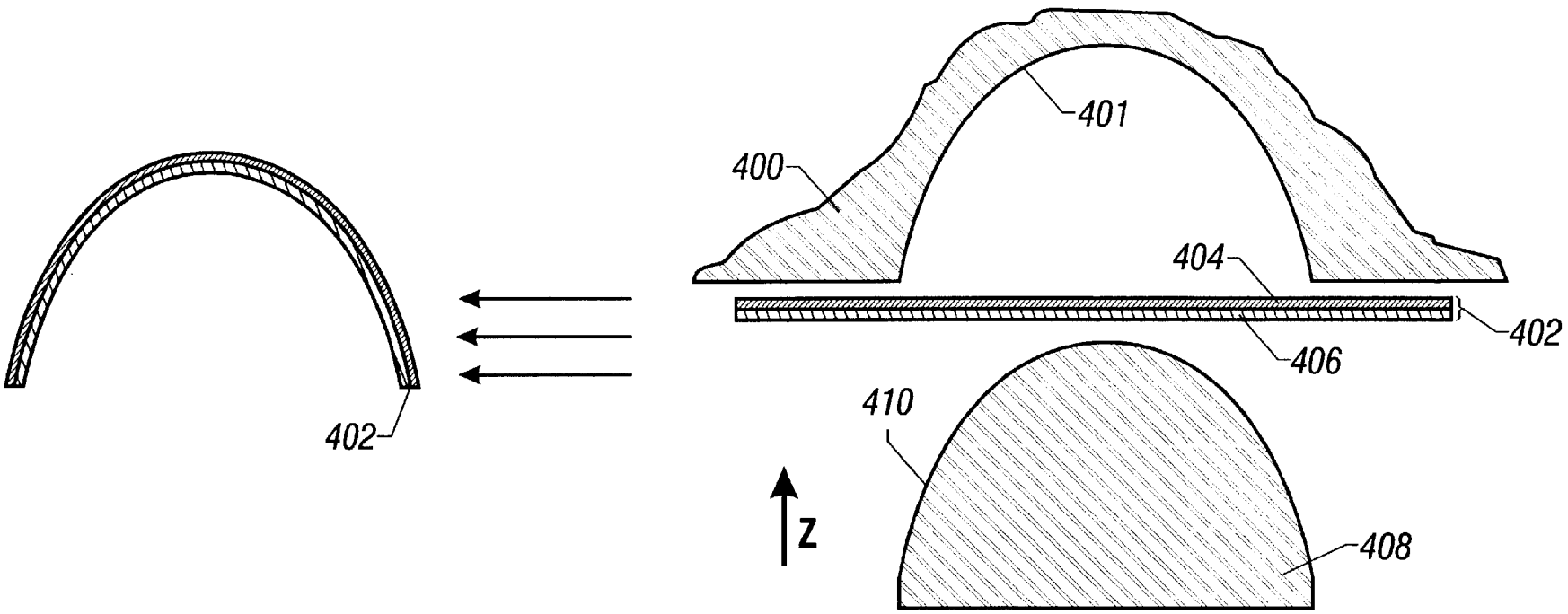
FIG. 5 is a diagram illustrating the manufacture of a liner used in the shaped charge of FIG. 4A.

Referring to FIG. 5, a method according to one embodiment of the invention for manufacturing a substantially non-conical liner is shown. The process uses liner forming equipment having a die cavity 400 having a generally bowl-shaped depression 401. A liner 402*a* that includes two relatively flat sheets 404, 406 of material is placed adjacent the depression 401 and a stamping member 408 moving in direction Z stamps the sheets 404, 406 into the depression 401 to form a generally bowl-shaped liner 402. The receiving member 400 and the stamping member 408 can be made of a hard metal, such as steel.

Other embodiments are within the scope of the following claims. For example, instead of stamping two sheets of preselected materials, one sheet can be stamped as described with FIG. 5 while a second layer material (e.g., particulated metal) can be sprayed onto the convex side of the stamped layer. Other methods of forming the multiple-layered liners can also be used. In addition, liners having more than two layers of materials can also be used.

Although the present invention has been described with reference to specific exemplary embodiments, various modifications and variations may be made to these embodiments without departing from the spirit and scope of the invention as set forth in the claims.

What is claimed is:

1. A shaped charge, comprising:

a case;

an explosive charge contained in the case; and a liner having a substantial portion that is generally bowl-shaped, wherein the liner includes a first layer of a first material and a second layer of a second, different material, the first layer having a portion with a first thickness and the second layer having a portion with a second thickness, the first layer positioned between the explosive charge and the second layer, the first thickness to second thickness ratio being less than about 3:1 and greater than about 1:3, and the first layer having a low temperature melting point such that upon detonation the first layer substantially disintegrates to reduce slug formation, wherein the bowl-shaped liner has a shape selected from the group consisting of generally parabolic, generally hemispherical, and tulip-shape; and wherein the first material is selected from the group consisting of zinc, lead, tin, a particulated metal, a metal alloy, plastic, nylon, and epoxy.

2. A shaped charge, comprising:

a case, an explosive charge contained in the case; and a liner having a substantial portion that is generally bowl-shaped, wherein the liner includes a first layer of a first material and a second layer of a second, different material, the first layer having a portion with a first thickness and the second layer having a portion with a second thickness, the first layer positioned between the explosive charge and the second layer, the first thickness to second thickness ratio being less than about 3:1 and greater than about 1:3, and the first layer having a low temperature melting point such that upon detonation the first layer substantially disintegrates to reduce slug formation, wherein the first material includes a material selected from the group consisting of plastic, nylon, and epoxy.

3. The shaped charge of claim 1, wherein the second material includes a metal.

4. The shaped charge of claim 3, wherein the metal includes a material selected from the group consisting of copper, nickel, gold, tantalum, silver, and a metal alloy.

5. The shaped charge of claim 1, wherein the first thickness to second thickness ratio is selected from a range defined between 2:1 and 1:2.

6. A shaped charge comprising:

a case;

an explosive contained in the case; and a liner having a substantial portion that is generally bowl-shaped and having a first layer of a first thickness and a second layer of a second thickness, the first layer being positioned between the explosive and the second layer and formed of a material that substantially disintegrates upon detonation, the first thickness and the second thickness having a relative ratio selected from a range defined between about 3:1 and 1:3, wherein the bowl-shaped liner has a shape selected from the group consisting of generally parabolic, generally hemispherical, and tulip-shape; and wherein the first material is selected from the group consisting of zinc, lead, tin, a particulated metal a metal alloy, plastic, nylon, and epoxy.

7. The shaped charge of claim 6, wherein the second layer is formed of a material selected from the group consisting of copper, nickel, gold, tantalum, silver, and a metal alloy.

8. The shaped charge of claim 6, wherein the relative ratio of the first thickness to the second thickness is selected from a range defmed between 2:1 and 1:2.

9. A shaped charge comprising:

a case;

an explosive contained in the case; and a liner that is generally bowl-shaped and having at least two layers, an inner layer to contribute to formation of a perforating jet and an outer layer that substantially disintegrates to reduce slug formation upon detonation, the liner having a portion with a total thickness and the inner layer having a portion with a thickness that is greater than about 25% of the total thickness, wherein the bowl-shaped liner has a shape selected from the group consisting of generally parabolic, generally hemispherical, and tulip-shape; and wherein the outer layer is formed of material selected from the group consisting of zinc, lead, tin, a particulated metal, a metal alloy, plastic, nylon, and epoxy.

10. The shaped charge of claim 9, wherein the thickness of the inner layer portion is less than about 75% of the total thickness.

11. The shaped charge of claim 2, wherein the first thickness to second thickness ratio is less than about 2:1 and greater than about 1:3.

12. A shaped charge comprising:

a case;

an explosive contained in the case; and a liner having a substantial portion that is generally bowl-shaped and having a first layer of a first thickness and a second layer of a second thickness, the first layer being positioned between the explosive and the second layer and formed of a material that substantially disintegrates upon detonation, the first thickness and the second thickness having a relative ratio selected from a range defined between about 3:1 and 1:3, wherein the first material is selected from the group consisting of plastic, nylon, and epoxy.

13. The shaped charge of claim 12, wherein the first thickness and the second thickness have a relative ratio selected from a range defined between about 2:1 and 1:2.

14. A shaped charge comprising:

a case;

an explosive contained in the case; and a liner that is generally bowl-shaped and having at least two layers, an inner layer to contribute to formation of a perforating jet and an outer layer that substantially disintegrates to reduce slug formation upon detonation, the liner having a portion with a total thickness and the inner layer having a portion with a thickness that is greater than about 25% of the total thickness, wherein the outer layer is formed of a material selected from the group consisting of plastic, nylon, and epoxy.

* * * * *